US005188370A

United States Patent [19]

Vlahos

[11] Patent Number: 5,188,370

[45] Date of Patent: Feb. 23, 1993

[54] GAME CARDS IN MULTIPLE FORM AND A CONTAINER/DISPENSER DEVICE

[76] Inventor: Mary E. Vlahos, 4 Nicholas Rd., Plaistow, N.H. 03865

[21] Appl. No.: 634,743

[22] Filed: Dec. 27, 1990

[51] Int. Cl.[5] ..... A63F 3/06

[52] U.S. Cl. ..... 273/269; 206/824; 206/390

[58] Field of Search ..... 273/240, 269; 283/71, 283/53, 61, 62, 66.2, 903; 206/820, 824, 389, 390, 401, 409, 831, 315.1; 225/17, 76; 221/7, 70, 206

[56] References Cited

U.S. PATENT DOCUMENTS

| | | | |
|---|---|---|---|
| 2,497,341 | 2/1950 | Bisson | 273/269 |
| 3,176,891 | 4/1965 | Goldsholl | 283/62 X |
| 3,456,854 | 7/1969 | Condy | 225/17 |
| 3,485,349 | 12/1969 | Chaney | 206/820 |
| 3,621,964 | 11/1971 | Riddle et al. | 221/7 X |
| 3,896,691 | 7/1975 | Granger et al. | 225/17 |
| 3,956,049 | 5/1976 | Johnsen | 283/903 X |
| 4,165,878 | 8/1979 | Frain | 273/269 |
| 4,387,297 | 6/1983 | Swartz et al. | 235/462 |
| 4,885,700 | 12/1989 | Kondziolka et al. | 273/269 X |

FOREIGN PATENT DOCUMENTS 0016640 of 1892 United Kingdom ..... 225/76

*Primary Examiner*—V. Millin
*Assistant Examiner*—William M. Pierce
*Attorney, Agent, or Firm*—Edward A. Gordon

[57] ABSTRACT

In combination, a flexible sheet member including a plurality of bingo game cards, the upper surface of each card having indicia thereon in final bingo game form ready for use by players, the peripheral edges of adjacent game cards being adapted to be detached from each other whereby a selected number of the game cards can be detached as a uniform structure. The sheet member is disposed about a reel member. Also included is a dispensing container having a pair of support members positioned in spaced parallel relationship, the support members being adapted to retain the reel member in rotatable movement within the container. The container is provided with a dispensing opening through which the sheet member of game cards can be drawn and is also adapted to enable a selected number of game cards to be severed as a unitary group structure.

1 Claim, 4 Drawing Sheets

GAME CARDS IN MULTIPLE FORM AND A CONTAINER/DISPENSER DEVICE

BACKGROUND OF THE INVENTION

1. Field of the Invention

The present invention relates to game employing game cards and more particularly to a new and improved combination of a plurality of bingo game cards in detachable multiple form and a device for containing and dispensing the same.

2. Description Of Prior Art

In the play of the well-known bingo game, the player places markers on different numbers appearing on a bingo card. Conventionally, the player may be playing a number of such cards concurrently. The cards must be suitably supported so that the player can scrutinize all of the cards as each number is called in the play of the game. Upon conclusion of a game, all of the markers must be removed from the cards so that the cards may be re-marked when used in a subsequent game.

At times, the player may be concurrently playing a substantial number of cards, such as 20 or more cards. It has been found difficult to maintain a relatively large number of cards aligned in front of the player. Further, the markers may fall or be moved as by jostling and constitute a vexatious problem in the play of a substantial number of cards concurrently.

In other forms of the bingo game cards, the cards are marked by markers which provide a permanent mark on the numbers which have been called during the play of the game. In this form of the bingo game, the bingo game cards are disposed of after each game and new game cards are used for the next game. With such markers it is extremely difficult if not impossible to maintain a relatively large number of cards aligned in front of the player while the player uses the permanent marker to mark the numbers called in the play of the game.

One attempted solution to the problem of maintaining the cards in side-by-side lateral disposition is illustrated in U.S. Pat. No. 2,497,341 of Leo J. Bisson. As shown therein, each of the cards is provided with interlocking means on its peripheral edges so as to interlock with the laterally adjacent cards, permitting a number of the cards to be locked together.

Another arrangement for supporting bingo cards on the lap of a player is illustrated in U.S. Pat. No. 3,811,680 of Frederick E. Benesch. As shown therein, the support for the cards comprises a plurality of boards interlinked to accommodate a number of bingo cards concurrently used by the player. Removable legs are attachable to the boards so as to permit the boards to be supported on the lap of the player at an inclined angle or on a table surface in front of the player. Benesch suggests the use of a clear overlay sheet having edges overlapping the edges of the table and provided with a downturned flange for preventing lateral displacement of the sheet on the table. Benesch further suggests that one edge of the overlay sheet may be secured to the table.

Another device for holding a plurality of bingo cards is illustrated in U.S. Pat. No. 4,165,878 of John J. Frain. Frain discloses the use of a markable panel which is inserted in a pocket to overlie the bingo number field, with an overlying cover panel of the pocket provided with openings through which the transparent sheet may be marked. Frain teaches that the transparent insert sheet may be shifted to expose an unmarked portion in playing a second game and teaches that at least four plays may be carried out by so repositioning the transparent insert sheet.

Charles Cole discloses, in U.S. Pat. No. 4,133,536, another form of bingo card holding and marking device wherein a transparent plastic sheet is provided with a plurality of groups of circular holes. The sheet has an adhesive coating on one surface to permit it to be releasably mounted on a plurality of bingo cards, in turn releasably secured to an adhesive coating on a backing plate to permit working of the numbers of each of the bingo cards so that a bingo player may play a plurality of cards simultaneously. The cards may be marked through the openings in a manner similar to the marking through the openings in the frame structure.

The concept of marking a transparent overlay sheet in the play of a game utilizing a card having different indicia thereon is illustrated in U.S. Pat. No. 3,603,592 of Joe Bury. As shown therein, the game apparatus consists of rectangular background cards having transparent front panels secured to the background card at three edges, leaving an open edge. Auxiliary cards are inserted between the transparent front panel and the background card, and a crayon is provided for marking a box of the auxiliary cards. The crayon markings on the transparent panel are erasable to permit reuse of the assembly.

U.S. Pat. No. 4,630,830 discloses still another form of a bingo game card holder having a base defining a plurality of pockets for holding one each bingo game cards in laterally related disposition. A light-transmissive cover is retained releasably in overlying relationship to the pockets for releasably retaining the selected bingo game cards therein. The exposed upper surface of the cover is constructed to be readily marked by conventional erasable marking elements to identify the called numbers appearing on the cards retained in the pockets. The cover is releasably retained by retaining structure at opposite portions thereof and the periphery of the cover is spaced inwardly of the periphery of the base and structure for defining access to an edge portion of the cover for facilitated installation and removal. The base also defines an integral handle for use in carrying the assembled card holder.

The foregoing patents as well as the following U.S. Patents are believed to exemplify the present state of the art with respect to such game devices: 2,497,341 4,270,774 4,500,091.

While such prior art devices provide improvements in the areas intended, there still exists a great need for a simplified structure which permits a selected number of game cards to be maintained in attached relationship in the same plane in combination with a dispenser for dispensing a selected number of cards whereby the number of game cards selected are dispensed with the peripheral surfaces of the game cards attached to each other to form a sheet-like plurality of game cards which do not move relative to each other when, for example, they are marked by the player during the course of the game.

Accordingly, a principle desirable object of the present invention is to provide game cards which are releasably attached to each other and a dispenser for the game cards which overcome the disadvantage of the prior art.

Another desirable object of the present invention is to provide a plurality of game cards which are made of suitable flexible material whereby it may be wound about a suitable reel which may be positioned within a container when not in use and thereafter in a dispenser for dispensing various selected numbers of game cards for players in laterally juxtaposed side-by-side relationship to thereby play all of the selected cards concurrently.

Another desirable object of the present invention is to provide an improved set of game cards which are releasably attached to each other at the periphery of the game cards and which are sufficiently flexible to be formed into a roll and a container of the kind for receiving a roll of the game cards in compact form and dispensing selected numbers of game cards in a unitary group structure.

A still further desirable object of the present invention is to achieve the above desirable objects with an essentially simple structure lending itself to inexpensive mass production.

These and other desirable objects of the present invention will in part appear hereinafter and will in part become apparent after consideration of the specification with reference to the drawings and the claims.

SUMMARY OF THE INVENTION

An important feature of the present invention is to provide in combination, a flexible sheet member comprising a plurality of bingo game cards, the upper surface of each card having indicia thereon in final bingo game form ready for use by players, the peripheral edges of adjacent game cards being adapted to be detached from each other whereby a selected number of the game cards can be detached as a uniform structure to facilitate playing of all of the selected bingo game cards concurrently by the player, the sheet member being disposed about a reel member; and a dispensing container, the container having a pair of support members positioned in spaced parallel relationship, the support members being adapted to retain the reel member for rotatable movement within the container. The container is provided with a dispensing opening through which the sheet member of game cards can be drawn and a severing member to enable a selected number of game cards to be severed as a unitary group structure. In an alternate embodiment, the container is provided with counter means to indicate the number of bingo game cards dispensed to players and/or the total number of cards dispensed over a selected period.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
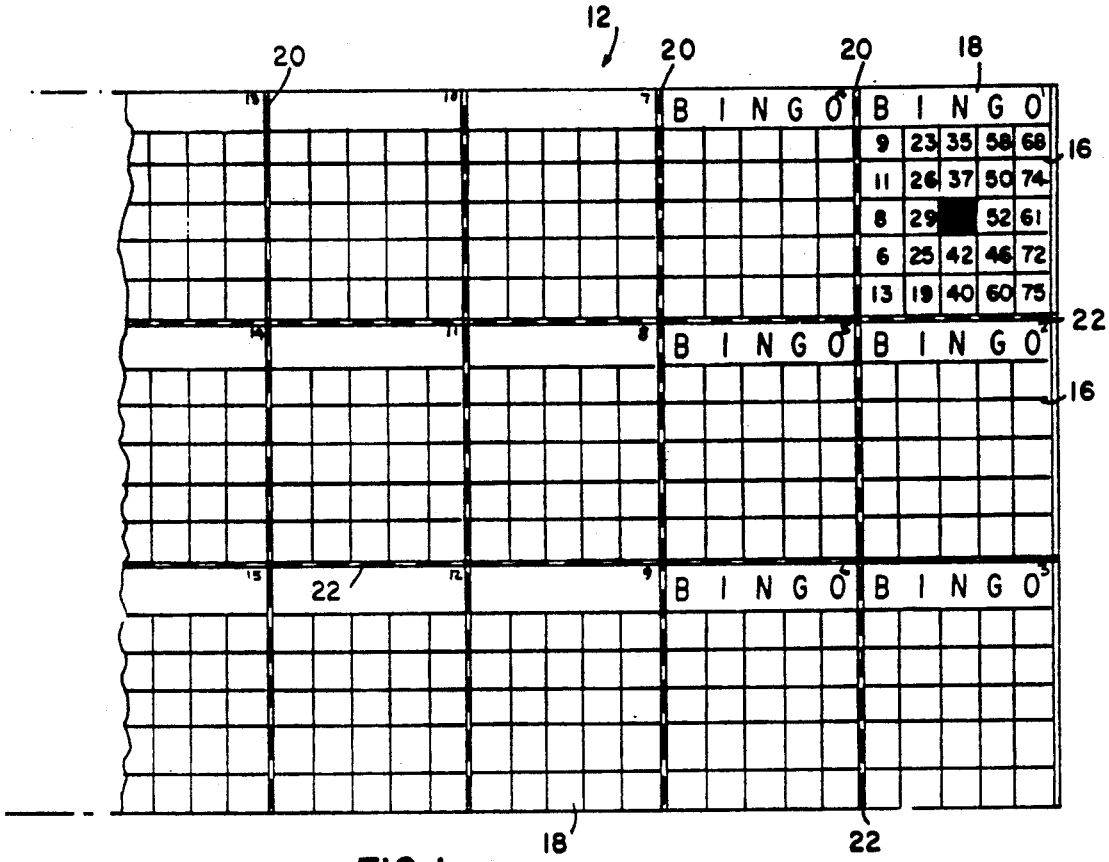
FIG. 1 is a fragmentary top plan view of a plurality of bingo game cards in the form of a flexible sheet member embodying the principles of the present invention.

Referring now to the drawings, the numeral 10 designates generally the embodiment of the invention illustrating the new and improved combination of a flexible sheet member 12 and a dispensing container 14.

As best seen in FIG. 1, the flexible sheet member 12 is preferably formed of a flexible material such as paper and preferably in an elongated rectangular strip shape. Indicia 16 is imprinted on the sheet member 12 as shown in complete detail in FIG. 3 in the form of a bingo card designated generally by the numeral 18. The selected indicia may include at least the block lines 16L, block numbers 16N, letter words 16W and card identification numbers 16I. The present invention also contemplates one form of the bingo game where the block numbers are omitted from the cards so as to be inserted by the players prior to the game.

Figure 2:
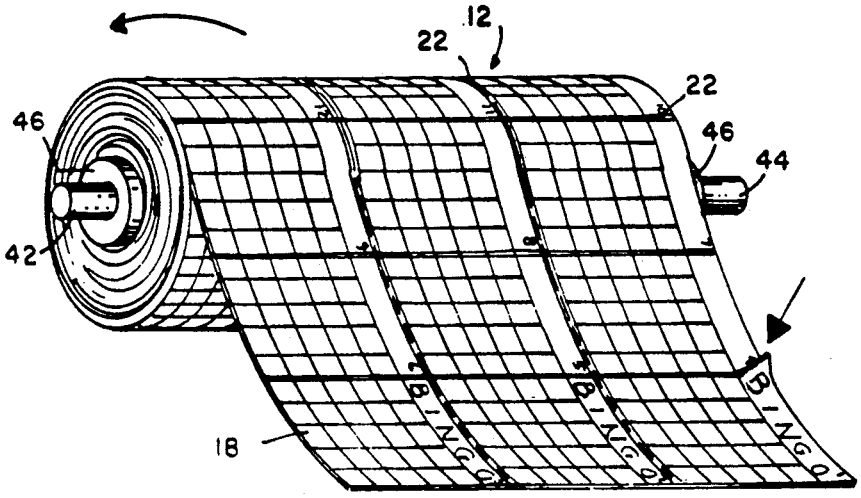
FIG. 2 is a perspective view of a plurality of bingo game cards in the form of a flexible sheet member rolled about a reel member in accordance with the present invention.
Figure 3:
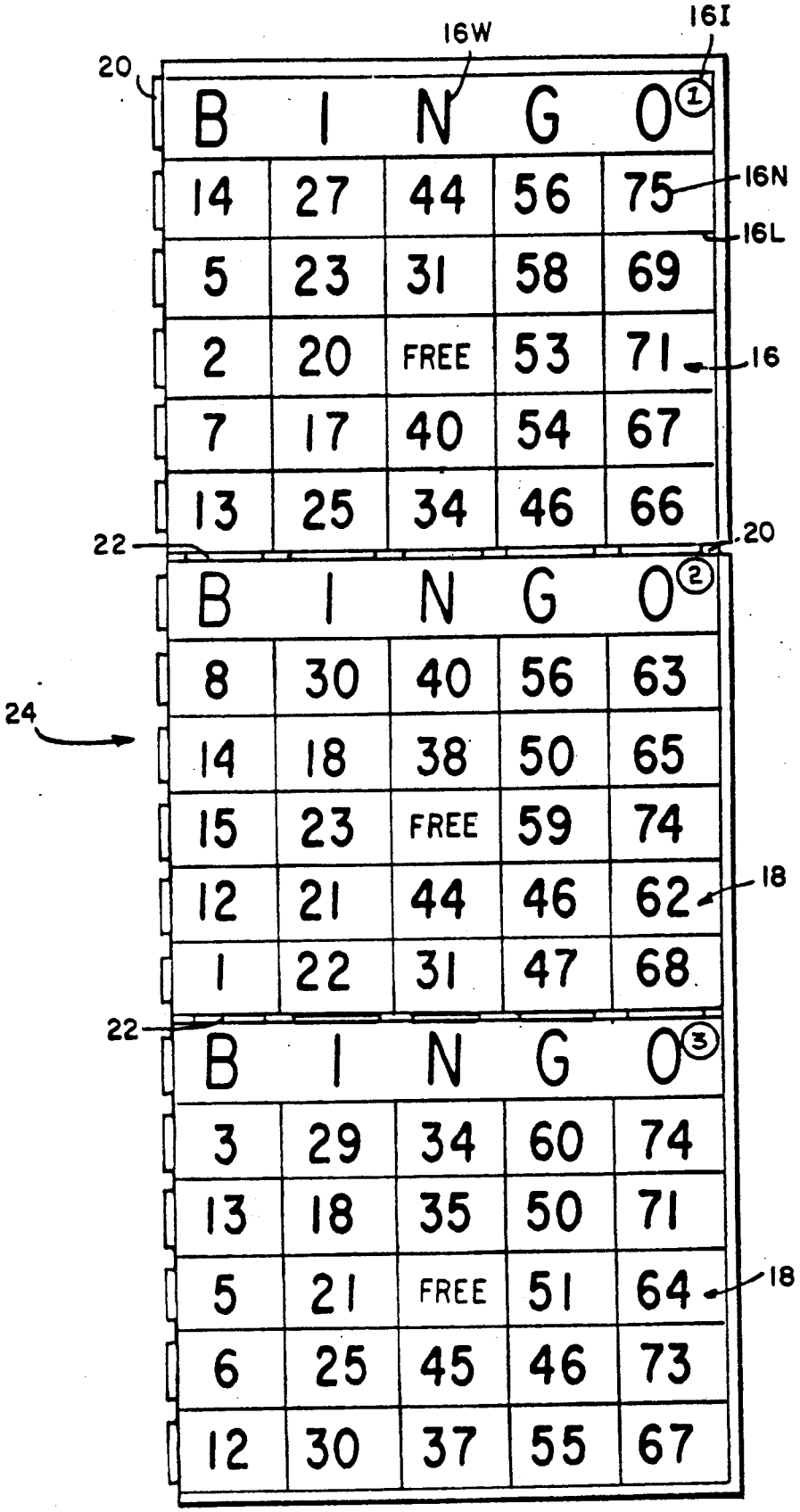
FIG. 3 is an enlarged top plan view of a unitary group structure of a selected number of game cards severed, for example, from the sheet member of FIG. 2.
Figure 7:
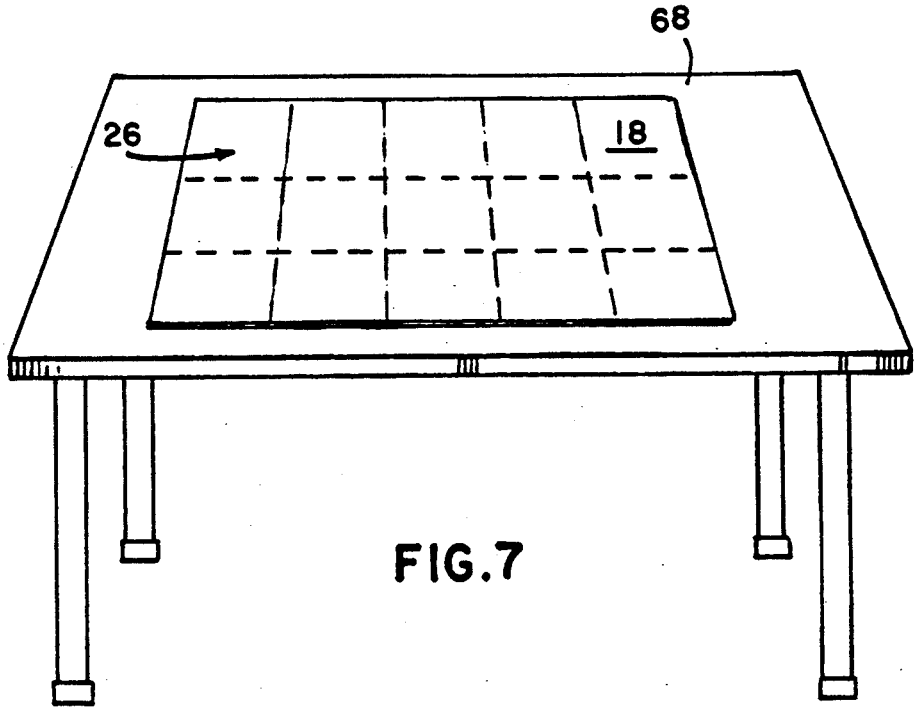
FIG. 7 is a perspective view of another embodiment of a player's selected number of game cards which have been severed from a flexible sheet member of the dispensing container and placed as a unitary group structure on the player's table.

The peripheral edges of adjacent bingo cards 18 terminate in common space sections 20 which define a plurality of perforations 22 which facilitate detachment of the selected number of bingo game cards 18 in the form of a total unitary group structure as illustrated in FIGS. 3 and 7. In FIG. 3 the detached unitary group structure, illustrated generally by the numeral 24, comprises three bingo game cards attached together to form a unitary group structure. As shown in FIG. 2, the set of three game cards can be detached manually (the initiation of which is shown by the arrow) from the roll of the flexible sheet member 12. As discussed further hereinafter, the detached unitary group structure, illustrated generally by the numeral 26 in FIG. 7, consists of fifteen juxtaposed bingo game cards 18.

Figure 4:
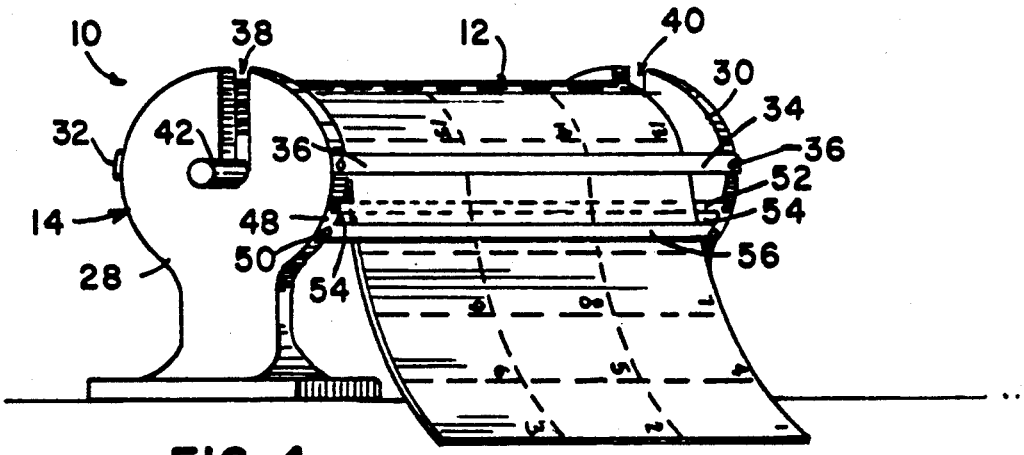
FIG. 4 is a perspective view of a flexible sheet member comprising a plurality of bingo game cards in combination with a dispensing container in accordance with the present invention.
Figure 5:
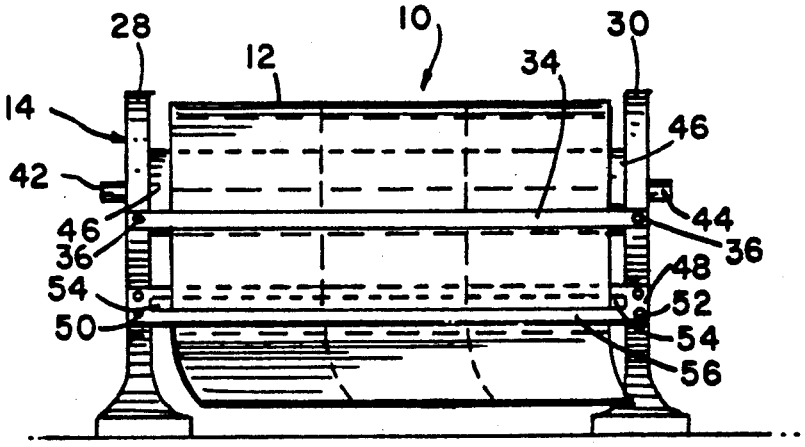
FIG. 5 is a front elevational view of the combination game card flexible sheet member and dispenser of FIG. 4.

Referring now more particularly to FIGS. 2, 4 and 5, the dispensing container 14 contains a pair of spaced parallel support members 28 and 30 which are held in spaced relationship to each other by a pair of elongated transverse members 32 and 34 attached to the respective support members 28 and 30 by suitable bolt members 36.

In the embodiment shown in FIGS. 4 and 5, the support members are provided with slots 38 and 40 defined by the upper portion of the respective support members 28 and 30. The slots 38 and 40 are adapted to receive the round end members 42 and 44 of reel member 46 (shown in phantom in FIG. 5). The present invention also contemplates conventional bearing members (not shown) disposed in the bottom portion of the slots 38 and 40 to contact the end members 42 and 44 and facilitate rotation of the reel member 46.

One end of the elongated flexible sheet member strip can be releasably attached to the reel member by a conventional adhesive material (not shown) so that when the reel is rotated in one direction (as shown by the arrow in FIG. 2) the flexible sheet member 12 will be rolled about the reel member 46 as best seen in FIG. 2. It is to be understood that the reel member 46 may be rolled outside of the dispensing container 14 such as, for example, when many reels are to be provided with the flexible sheet members 12 and placed in supply boxes until used at which time the rolled reel is inserted into the dispensing container 14 as shown in FIGS. 4 and 5. The dispenser container 14 is provided with a transverse member 48 having opposing ends which are secured to the forward portion of support members 28 and 30 by suitable means such as bolts 50 and 52. The transverse member 48 is provided with a defined elongated opening 54 through which the flexible sheet member 12 is inserted through the opening 54 preferably from the outside of the transverse member 48 to the inside thereof so that it can be brought into contact with the cutting edge 56 of the transverse member 48.

Figure 6:
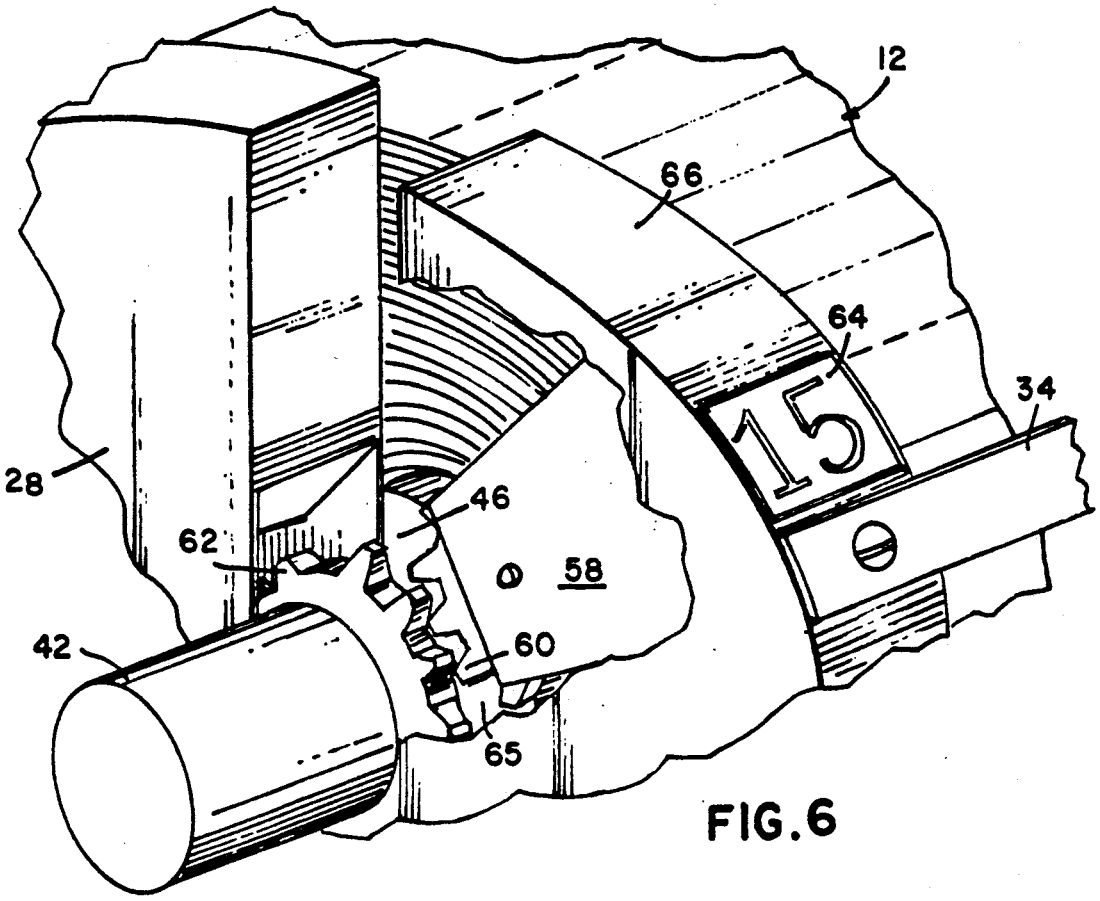
FIG. 6 is an enlarged fragmentary perspective view illustrating an embodiment of the dispensing container of the present invention including a card dispensing counting means.

Referring now to FIG. 6, there is illustrated an alternate embodiment of dispensing container 14 which includes a bingo card counting means for counting the number of bingo cards dispensed. As illustrated, a support member such as member 28 can be provided with a conventional mechanical and/or electrical device 58 (including a power source such as batteries not shown) the upper portion of which can be connected to the inner surface of the chamber 65 defined by the housing 66 forming the support member 28 and the bottom portion of which can be matingly connected to the reel member 42 by respective gear type members 60 and 62. In this embodiment, the number of cards dispensed are shown by the numbers (15 for example) in the opening 64 defined by the surface 66 of the support member 28. In this embodiment, the rotation of the reel when dispensing cards activates the counting device 58. It is to be understood that the present invention also contemplates other counting devices such as, for example, a laser scanning system as described in U.S. Pat. No. 4,387,297 or an electrooptical scanning device as described in U.S. Pat. No. 4,386,827. As mentioned previously, also contemplated is an embodiment which includes two counters, for example, where one is used to count the number of cards dispensed to each player and the other is used to provide the total number of cards dispensed to players during a selected game period.

In operation, the flexible sheet member 12 comprising a plurality of bingo game cards is pulled from the reel 46 through the opening 54. When the selected number of game cards are drawn, the end perforations 22 of the flexible sheet member 12 are then brought into contact with the cutting edge 56 to sever the unitary group structure of cards from the roll. It is to be understood that the number of lateral cards defined by the flexible sheet member 12 and shown as three in FIGS. 1 and 4, for example, may be varied in size from one to any number selected in excess thereof.

As illustrated in FIG. 7, a unitary group structure 26 of fifteen bingo game cards, for example, when detached from the roll of the flexible sheet member 12 can be placed on the players table 68. As shown, the unitary group structure 26, which is formed of the fifteen playing game cards selected, maintains all fifteen of the game cards in laterally juxtaposed side-by-side relationship to facilitate playing of all of the selected game cards concurrently by the player. It can be appreciated that this feature of the invention will apply to any number of game cards selected by the player which are to be played concurrently by the player. It can be appreciated that in accordance with the present invention one hand of the player, for example, will hold all cards in side-by-side relationship to each other whereby the players can mark all cards with the other hand.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. In combination, an elongated flexible sheet member comprising a plurality of bingo game cards;

said sheet member having a plurality of spaced horizontal and spaced vertical perforation means for separating said game cards, said perforation means defining the peripheral edges of adjacent bingo game cards;

said game cards having upper and lower surfaces;

the upper surface of each card having indicia thereon in final bingo game form ready for use by players;

the peripheral edges of laterally adjacent game cards being adapted to be detached from each other along the perforation means whereby a selected number of the game cards can be detached as a unitary group structure;

a reel means;

said flexible sheet member being sufficiently flexible and elongated whereby said sheet member is rolled about said reel means;

a horizontal elongated dispensing container;

said dispensing container comprising a pair of support members positioned in spaced parallel relationship adjacent the opposing ends of said dispensing container;

means associated with said support members to retain said reel means and the flexible sheet member rolled about said reel means in rotatable movement within said container;

said container having a dispensing opening through which the lateral section of said flexible sheet member of bingo game cards can be drawn from said reel means; and a cutting edge means attached to said dispensing opening to enable a selected number of laterally juxtaposed game cards to be severed as a unitary group structure.

* * * * *